US006913172B2

(12) United States Patent
Damrath et al.

(10) Patent No.: US 6,913,172 B2
(45) Date of Patent: Jul. 5, 2005

(54) APPARATUS FOR PRESSING SHIRTS HAVING A SUBDIVIDED INFLATABLE BODY

(75) Inventors: Joachim Damrath, Bachhagel (DE); Gerhard Wetzl, Sontheim (DE); Markus Spielmannleitner, Ellwangen (DE); Kathrin Redlin, Berlin (DE); Sebastian Siegele, Berlin (DE); Bodo Urich, Berlin (DE)

(73) Assignee: BSH Bosch und Siemens Hausgeräte GmbH, Munich (DE)

( * ) Notice: Subject to any disclaimer, the term of this patent is extended or adjusted under 35 U.S.C. 154(b) by 0 days.

(21) Appl. No.: 10/600,407

(22) Filed: Jun. 20, 2003

(65) Prior Publication Data

US 2004/0069818 A1 Apr. 15, 2004

Related U.S. Application Data

(63) Continuation of application No. PCT/EP01/14117, filed on Dec. 3, 2001.

(30) Foreign Application Priority Data

Dec. 20, 2000 (DE) ..... 100 63 672

(51) Int. Cl.[7] ..... A41H 5/02
(52) U.S. Cl. ..... 223/67
(58) Field of Search ..... 223/67, 72, 73, 223/74

(56) References Cited

U.S. PATENT DOCUMENTS 2,284,232 A * 5/1942 Richa ..... 223/57
3,165,244 A 1/1965 Dosal
5,148,955 A 9/1992 Cares

FOREIGN PATENT DOCUMENTS

DE 199 07 929 A1 8/2000
JP 9-294899 11/1997

* cited by examiner

*Primary Examiner*—John J. Calvert
*Assistant Examiner*—James Smith
(74) *Attorney, Agent, or Firm*—John T. Winburn; Russell W. Warnock; Craig J. Loest

(57) ABSTRACT

A shirt-shaped inflatable body for pressing shirts and on which the shirt is stretched flat includes lateral cavities, which are inflated by an increased pressure, in the sides of the trunk section of the inflatable body. The cavities are supported by a frame located inside the inflatable body and press the trunk section outwards, forming a flat shape. The pressure in the lateral chambers located inside the casing of the inflatable body is increased by the fact that both the casing of the lateral chambers and the casing of the inflatable body are permeable to air and that the lateral chambers are directly supplied with air by a fan, whereas the remaining areas of the inflatable body are only inflated with the air that flows through the casing of the lateral chambers against a flow resistance.

18 Claims, 1 Drawing Sheet

APPARATUS FOR PRESSING SHIRTS HAVING A SUBDIVIDED INFLATABLE BODY

CROSS-REFERENCE TO RELATED APPLICATION

This application is a continuation of copending International Application No. PCT/EP01/14117, filed Dec. 3, 2001, which designated the United States and was not published in English.

BACKGROUND OF THE INVENTION

Field of the Invention

The invention relates to an apparatus for pressing items of clothing, in particular shirts, having an inflatable body and devices for inflating the inflatable body with air, the inflatable body being internally subdivided into a plurality of cavities by partition walls.

The item of clothing or shirt that is to be pressed is tensioned from the inside by the inflatable body. As a result, the creases are removed. To improve the pressing result, the shirt is usually pressed, as in the case of conventional steam irons, under the action of moisture and heat. For such a purpose, the shirt is fitted in the damp state onto the inflatable body, and fixed, if appropriate, at the collar and button strip, and the inflatable body is inflated with heated air. As a result, the shirt is dried under tensioning. If the enclosure of the inflatable body is of air-permeable configuration, then it is also possible for the heated air to flow through the shirt and, thus, accelerate the drying operation.

An apparatus of the type mentioned in the introduction is known, for example, from U.S. Pat. No. 3,165,244 to Martin. This document describes an inflatable body that is subdivided into a plurality of chambers, it being possible for the individual chambers to be inflated, through separate lines, by a fan and for the supply of air into one chamber to be restricted in favor of the supply of air into the rest of the chambers. This makes it possible to achieve different pressures in the chambers. Disadvantageously, however, a high outlay is required for the lines and the valve that are necessary.

SUMMARY OF THE INVENTION

It is accordingly an object of the invention to provide an apparatus for pressing shirts, having a subdivided inflatable body that overcomes the hereinafore-mentioned disadvantages of the heretofore-known devices of this general type and that provides specifically different conditions in the various cavities of the inflatable body with low outlay and high repetition accuracy.

With the foregoing and other objects in view, there is provided, in accordance with the invention, an apparatus for pressing items of clothing, including an inflatable body having partition walls and being internally subdivided into a plurality of cavities by the partition walls, the cavities including at least one indirectly inflated cavity and at least one adjacent cavity, devices for inflating the inflatable body with air communicating with the inflatable body, and a partition wall of the walls separating the at least one indirectly inflated cavity from the at least one adjacent cavity and passing air therethrough counter to a flow resistance, the indirectly inflated cavity being inflated with air exclusively through the partition wall. Preferably, the items of clothing are shirts.

On account of the flow resistance of the air-permeable partition walls, it is possible for the indirectly inflated cavities to be inflated with a time delay. As a result, the shirt that is to be pressed can be moved into an optimum position, in the first instance, at the beginning of the tensioning operation.

If air can escape through the enclosure of an indirectly inflated cavity, it is, additionally, possible, in the stationary inflated state, to achieve different pressures in the cavities. To achieve a fold-free pressing result, the shirt that is to be pressed can, thus, be tensioned to differently pronounced extents in a specific manner in different directions.

Advantageously, the partition walls and/or the enclosures of the cavities are produced from a textile material, it also being conceivable to use air-permeable sheet materials. The air permeability of the individual partition walls and/or enclosures, and, thus, the conditions in the various cavities, can, thus, be set in a particularly straightforward and cost-effective manner by selection of a certain textile material or, generally, of a flexible material with defined air permeability. Furthermore, the selection of a certain textile material or air-permeable material reliably establishes the conditions for the different cavities over a long period of time.

A framework disposed within the inflatable body can support, in particular, the enclosures of the cavities or the chambers in which the pressure prevailing is higher than in the rest. It is, thus, possible for the outer shape of the inflatable body to be influenced more strongly because the supported chambers can exert a higher force in the outward direction. In the case of a shirt-form inflatable body, this is advantageous particularly on the sides of the trunk because it is, thus, possible for the trunk section to be tensioned into a flat form by the outwardly directed lateral pressure and for a shirt fitted onto the inflatable body to be pressed corresponding to its cut and, thus, in more fold-free manner. The frameworks or bodies for supporting individual chambers within the inflatable body need not necessarily be rigidly connected to the shirt-pressing apparatus; it is also possible for them to be fastened exclusively on the enclosures of the inflatable-body cavities or of the inflatable body. The supporting bodies, which are, thus, fastened in a floating manner, can better follow the movements of the inflatable body and are advantageously of particularly lightweight configuration. Such non-rigidly fastened frameworks or bodies for supporting individual chambers may be used, for example, in the arm sections or in the top region of the inflatable body.

If the chambers are crashed or dropped steeply over a surface, it is possible for the orientation of this surface to influence the shape of the inflatable body in the inflated state. The orientation of this supporting surface, furthermore, can be used to compensate for external influences on the shape of the inflatable body. Such an influence may come, for example, from a button-strip clamp, which is disposed on the front side of the inflatable-body trunk section and fixes the button or buttonhole strip of a shirt fitted onto the inflatable body and, thus, subjects the inflatable body to a force either directly or indirectly through the shirt. This force may result in the inflatable body and/or the sections thereof being deflected and, thus, in folds in the shirt. To counteract this, the surfaces for supporting the laterally disposed chambers are turned about the vertical axis in the direction of the button-strip clamp.

In accordance with another feature of the invention, the indirectly inflated cavity defines an air-permeable enclosure.

In accordance with a further feature of the invention, the partition wall is of a substantially air-impermeable material and has a valve through which air can flow.

In accordance with an added feature of the invention, the inflatable body is shirt-shaped and has sleeve sections and a trunk section with narrow sides, and defines two side cavities on the narrow sides beneath the sleeve sections, the two side cavities defining side cavity enclosures and being inflated directly, the framework is disposed between the two side cavities, the side cavity enclosures, in an inflated state thereof, are supported on the framework, and the interior, outside the side cavities, is inflated with air exclusively through the partition wall to the side cavities.

From the cavities supplied directly with air or the cavities with relatively high pressures, it is possible to direct air, through a substantially flow-resistance-free connection, to locations at which a larger quantity of air is advantageous for the purpose of achieving a better pressing result. This may be, in particular, at those locations of the shirt to be pressed at which the fabric is present in a number of layers or drying is obstructed by additional applications. For such a purpose, the air can be directed with greater intensity into cavities located beneath the shirt sections that are more difficult to dry, or to direct air-supply devices that can direct the air out of the inflatable body and, from the outside, against the shirt that is to be pressed. Such direct air-supply devices may be disposed, for example, in the collar or cuff region of the shirt.

In accordance with an additional feature of the invention, the inflatable body has shoulder sections, the inflatable body defines further cavities in at least one of the sleeve sections and the shoulder sections, the further cavities being in substantially flow-resistance-free connection with the side cavities.

In accordance with yet another feature of the invention, there is provided at least one direct air-supply device directing air out of the interior of the inflatable body and against a shirt fitted onto the inflatable body from outside the shirt, the side cavities being in substantially flow-resistance-free connection with the at least one direct air-supply device.

In accordance with yet a further feature of the invention, the inflatable body has vertical axis, the trunk section is substantially flat and defines a plane, a means for fixing a trunk section of a shirt fitted onto the inflatable body, the fixing means running parallel to the vertical axis, and the framework has surfaces for supporting the side cavity enclosures, a surface normal of the surfaces being inclined with respect to the plane of the trunk section.

In accordance with yet an added feature of the invention, the inflatable body has vertical axis, the trunk section is substantially flat and defines a plane, a clamping-in device runs parallel to the vertical axis and fixes a trunk section of a shirt fitted onto the inflatable body, the framework has surfaces for supporting the side cavity enclosures, a surface normal of the surfaces being inclined with respect to the plane of the trunk section.

The crosspieces for reducing the airflow may be disposed, in particular, in the directly inflated chambers, in which a higher temperature is usually achieved. An excessively high temperature may lead to premature drying of shirt sections that come into contact therewith. As a result, energy is dissipated unnecessarily because the pressing operation is only terminated when the shirt is completely dry. The crosspieces can help influence the dissipation of energy to the various shirt sections so as to achieve more uniform drying of the various shirt sections and, thus, lower energy consumption. The divided-up regions with reduced airflow may be provided, in particular, at the locations at which, with an unobstructed airflow, the inflatable body would be overheated to an excessively pronounced extent. The heat insulation in such regions of reduced airflow increases as the flow rate of the air in these regions decreases.

In accordance with yet an additional feature of the invention, there is provided air-guiding crosspieces disposed within the side cavities and at least partly dividing up regions within the side cavities to reduce air flow in the regions.

In accordance with again another feature of the invention, the regions divided up by the crosspieces have only one inlet opening out into an interior of the side cavities.

In accordance with again a further feature of the invention, there is provided at least partially air-permeable wall, the regions divided up by the crosspieces being closed and separated from an interior of the side cavities by the at least partially air-permeable wall.

The enclosures of the indirectly inflated cavities and of the inflatable body may be connected, for example, by snap fasteners or zip fasteners, the snap fasteners advantageously being used in the region of the underside of the sleeves and zip fasteners advantageously being used in the region where the sleeves start.

In accordance with again an added feature of the invention, the inflatable body defines an enclosure and the directly inflated cavity defines an enclosure releaseably connected to the enclosure of the inflatable body.

In accordance with again an additional feature of the invention, the directly inflated cavity defines an enclosure releaseably connected to the air-permeable enclosure.

In accordance with a concomitant feature of the invention, the inflatable body defines an enclosure, the directly inflated cavity defines an enclosure and the enclosure of the directly inflated cavity is connected in at least one of punctiform and linear fashion to the enclosure of the inflatable body.

Other features that are considered as characteristic for the invention are set forth in the appended claims.

Although the invention is illustrated and described herein as embodied in an apparatus for pressing shirts, having a subdivided inflatable body, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
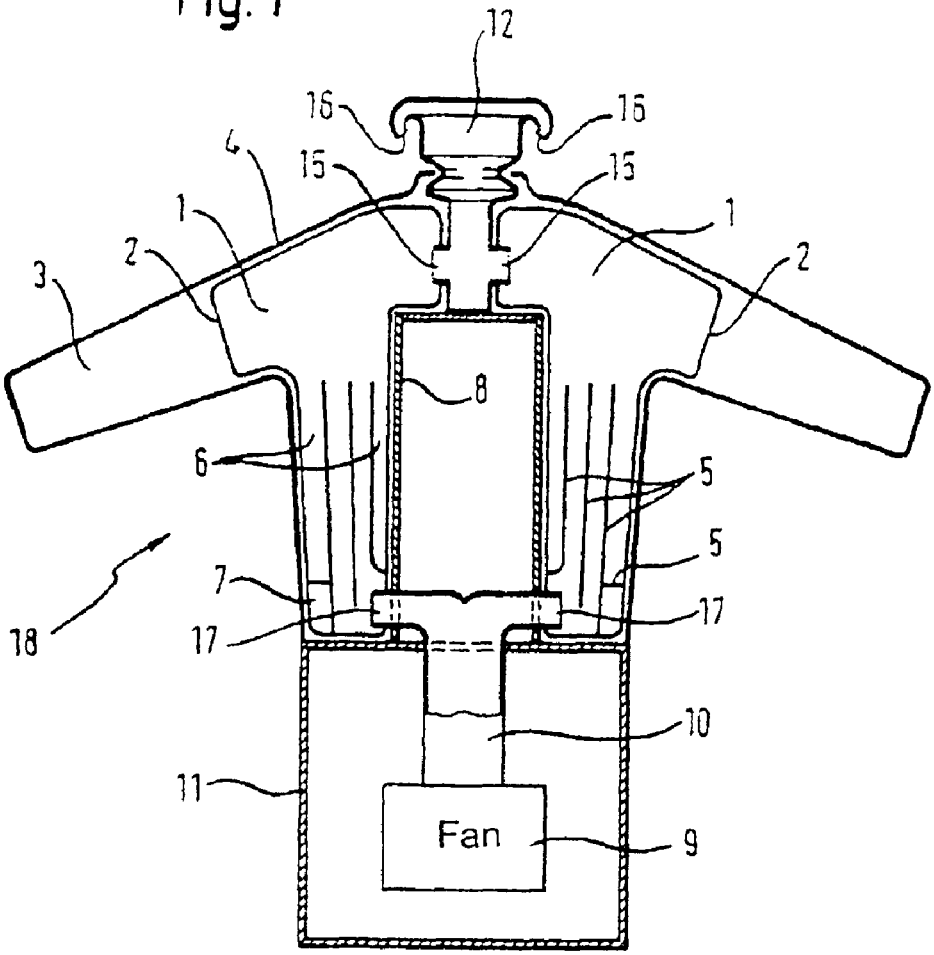
FIG. 1 is a vertical cross-sectional view of an apparatus for smoothing shirts according to the invention.

Referring now to the figures of the drawings in detail and first, particularly to FIG. 1 thereof, there is shown a shirt-pressing apparatus having a bottom part 11 with a shirt-form inflatable body 18 mounted thereon, a fan 9 with an integrated heating device being accommodated within the bottom part 11 to make possible inflation of the inflatable body 18 with heated air. The enclosure 4 of the inflatable body 18 is of an air-permeable textile material.

In the interior of the inflatable-body enclosure 4, a framework 8 is fastened on the bottom part 11. An air-supply device 12 with air inlets 15 and air outlets 16 is disposed at the top of the framework 8, to make possible direction of heated air out of the inflatable body 18 and, from the outside, directly onto the collar of a shirt fitted onto the inflatable body 18.

Also disposed within the inflatable-body enclosure 4 are two side chambers 1, on both sides of the framework 8. The enclosures 2 of the side chambers 1 are, likewise, made of an air-permeable textile material. The side chambers 1 extend over the entire height of the trunk section of the inflatable body 18 and project, in part, into the sleeve sections of the inflatable body 18. Those sections of the side chambers 1 that project into the sleeve sections may have a higher degree of air permeability to achieve a larger air stream into the sleeve sections. For example, it is possible, for such a purpose, for the enclosures 2 of the side chambers 1, in particular, on the outwardly directed end surfaces, to have a greater degree of air permeability and to have openings or to be provided with nozzles.

The fan 9 is connected to the side cavities 1 through an air channel 10 that leads from the bottom part 11 into the framework 8, divides up at the bottom of the framework 8 and has two air outlets 17, which each project through the two side parts of the framework 8. The side cavities 1 each have air inlets at the bottom, which are connected to the air outlets 17 of the air channel 10, and air outlets at the top, which are connected to the air inlets 15 of the air-supply device 12.

During operation, it is, thus, only the side cavities 1 that are inflated directly with heated air by the fan 9, the air flowing from the side cavities 1, on one hand, through the air-permeable enclosure 2 into the inflatable body 18 and, on the other hand, through the top openings into the air-supply device 12. From the inflatable body 18, the heated air flows through the air-permeable enclosure 4 to the shirt to dry the shirt. The air directed into the air-supply device 12 is discharged, again, through the air outlets 16, the quantity of air that flows through the air-supply device 12 being influenced by the flow resistance of the air outlets 16 and/or other restricting devices within the air-supply devices 12.

The air flows from the fan 9, virtually without resistance, into the side cavities 1 and from there, on one hand, counter to the flow resistance of the enclosure 2, into the cavity 3 of the inflatable body 18 and, on the other hand, counter to the flow resistance of the air outlets 16 and/or other restricting devices, into the air-supply device 12. In the stationary inflated state, the pressure distribution within the cavities 1, 3 is determined by the flow resistances at the transitions from the side cavities 1 to the interior 3 of the inflatable body and into the air-supply device 12 and/or when the air flows out through the inflatable-body enclosure 4. The flow resistances of the enclosures 2, 4 depends on the textile material used and on the enclosure surface and may, advantageously, be set such that, during operation, the air pressure in the side chambers 1 is considerably higher than in the rest of the interior 3 of the inflatable body 18. For example, it is possible to set a positive pressure of from 4 to 6 mbar in the side cavities 1 and a positive pressure of from 1 to 3 mbar in the inflatable-body interior 3.

In the inflated state, the side cavities 1 are supported against the framework 8 and force the enclosure 4 of the inflatable body 18 outward at the locations at which the enclosure 2 of the side cavities 1 butts against the enclosure 4 of the inflatable body 18, the enclosure 4 of the inflatable body 18 being subjected to a higher force at these locations, in particular, on account of the higher pressure in the side chambers 1. In particular, the enclosure 4 of the inflatable body 3 is forced outward laterally beneath the arm sections in the trunk region and upward in the shoulder region. It is, thus, possible for the trunk region of the inflatable body 18 to be converted into a flat form, which better corresponds to the shirt form and, thus, gives a pressing result with fewer folds.

Furthermore, crosspieces 5 are disposed in the side chambers 1 to prevent excessive heat dissipation from the inflatable body 18 in the region of the side cavities 1. With the aid of vertically running crosspieces 5, the air flowing out of the air outlets 17 is directed upward into the shoulder region of the side chambers 1 and the sleeve regions of the inflatable body 18. In addition, the crosspieces 5 divide up into a number of sections and chambers 6, 7 in which the air flows at a slower rate and/or is substantially at rest and gives rise to thermal insulation. This is advantageous particularly in the case of those locations of the enclosures 2 of the side cavities 1 that are located opposite the air outlets 17 because, without the crosspieces 5, the air would come into direct contact with this location and would heat it to an excessively pronounced extent. A chamber 7, in which an air cushion that is substantially at rest ensures thermal insulation, is, thus, provided at this location. In addition, regions 6 are divided up in the side cavities 1 beneath the shoulder regions, in the vicinity of the framework 8 on the inside and beneath the arm extensions on the outside, the regions 6 only having an inflow opening at their top ends and having a relatively small air flow prevailing therein.

The aim of the heat insulation precisely in the inflow region of the side cavities 1 is to set the heat dissipation at the various locations of the inflatable-body enclosure 4 such that a damp shirt fitted onto the inflatable body advantageously dries simultaneously at all the locations. Otherwise, the first-dried regions would be unnecessarily subjected to the action of warm air and energy would, thus, be used up unnecessarily. For example, without heat insulation, the side chambers 1 would be heated to a particularly pronounced extent in the inflow region at the bottom and a shirt fitted onto the inflatable body would dry too quickly on the sides at the bottom. With the aid of the crosspieces 5, the heat dissipation, which is reduced at these locations, can, instead, be directed into the regions further away.

The air-supply device 12 is connected directly to the side cavities 1, which are subjected to a relatively high pressure, to make possible for the collar of a wet shirt fitted onto the inflatable body to be better dried by having air flowing directly against the collar, the collar usually including a number of layers and, for this reason, being more difficult to dry. The air-supply device 12, around which the turned-up collar is positioned, has measures for fixing and clamping the turned-up collar.

Figure 2:
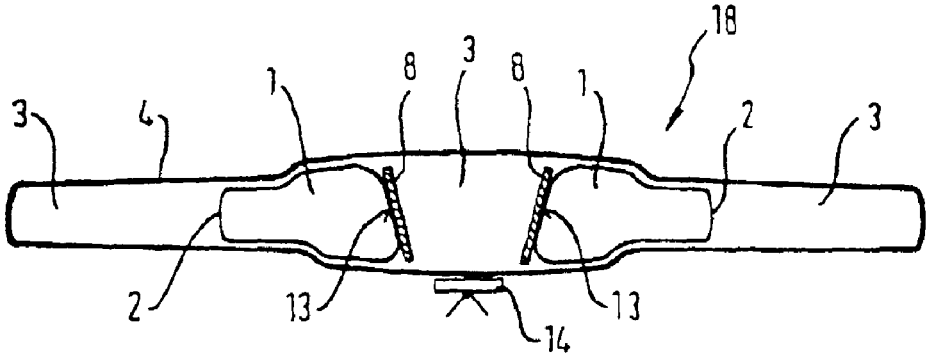
FIG. 2 is a cross-sectional view of a horizontal cross-section of the apparatus of FIG. 1.

FIG. 2 shows a horizontal section through the shirt-pressing apparatus according to the invention. Disposed at the front, in the chest region of the inflatable body 18, is a button-strip clamp 14 that serves for fixing the button or buttonhole strip of a shirt fitted onto the inflatable body. The button-strip clamp 14 is fastened on the bottom part 11 and extends substantially over the entire height of the inflatable body 18 as far as the beginning of the section of the air-supply device 12, around which the shirt collar is positioned. In the inflated state, the enclosure 4 of the inflatable body 18 pushes against the button-strip clamp 14 from behind. As a result, the inflatable body 18 tries to push itself away from the button-strip clamp 14 in the rearward direction. To counteract such deflection of the inflatable body 18, the side surfaces of the framework 8 are turned somewhat forward. As a result, the normal of these surfaces is inclined in relation to the inflatable-body trunk. Such inclination causes the force of the side chambers 1 to be directed not just perpendicularly outward, but also a little in the forward direction. As a result, despite the pressure exerted by the button-strip clamp 14, the inflatable body 18 is not deflected rearward.

We claim:

1. An apparatus for pressing items of clothing, comprising:

an inflatable body having partition walls and being internally subdivided into a plurality of cavities by said partition walls, said cavities including at least one indirectly inflated cavity and at least one adjacent cavity;

devices for inflating said inflatable body with air communicating with said inflatable body;

at least one of said partition walls separating said at least one indirectly inflated cavity from said at least one adjacent cavity and passing air therethrough counter to a flow resistance, said indirectly inflated cavity being inflated with air exclusively through said partition wall; and said cavities having at least intermittently different air pressures when inflated by said devices.

2. The apparatus according to claim 1, wherein said indirectly inflated cavity defines an air-permeable enclosure.

3. The apparatus according to claim 1, wherein said partition wall is of an air-permeable material.

4. The apparatus according to claim 1, wherein said partition wall is of a substantially air-impermeable material and has a valve through which air can flow.

5. The apparatus according to claim 1, wherein:

said inflatable body has an interior;

a framework is disposed in said interior;

said at least one adjacent cavity defines an enclosure; and said enclosure is supported against said framework in an inflated state of said body.

6. The apparatus according to claim 5, wherein:

said inflatable body is shirt-shaped and has sleeve sections and a trunk section with narrow sides, and defines two side cavities on said narrow sides beneath said sleeve sections, said two side cavities defining side cavity enclosures and being inflated directly;

said framework is disposed between said two side cavities;

said side cavity enclosures, in an inflated state thereof, are supported on said framework; and said interior, outside said side cavities, is inflated with air exclusively through said partition wall to said side cavities.

7. The apparatus according to claim 6, wherein:

said inflatable body has shoulder sections; and said inflatable body defines further cavities in at least one of said sleeve sections and said shoulder sections, said further cavities being in substantially flow-resistance-free connection with said side cavities.

8. The apparatus according to claim 6, further comprising at least one direct air-supply device directing air out of said interior of said inflatable body and against a shirt fitted onto said inflatable body from outside the shirt, said side cavities being in substantially flow-resistance-free connection with said at least one direct air-supply device.

9. The apparatus according to claim 6, wherein:

said inflatable body has vertical axis;

said trunk section is substantially flat and defines a plane;

a means for fixing a trunk section of a shirt fitted onto said inflatable body is provided, said fixing means running parallel to said vertical axis; and said framework has surfaces for supporting said side cavity enclosures, a surface normal of said surfaces being inclined with respect to said plane of said trunk section.

10. The apparatus according to claim 6, wherein:

said inflatable body has vertical axis;

said trunk section is substantially flat and defines a plane;

a clamping-in device runs parallel to said vertical axis and fixes a trunk section of a shirt fitted onto said inflatable body; and said framework has surfaces for supporting said side cavity enclosures, a surface normal of said surfaces being inclined with respect to said plane of said trunk section.

11. The apparatus according to claim 6, further comprising air-guiding crosspieces disposed within said side cavities and at least partly dividing up regions within said side cavities to reduce air flow in said regions.

12. The apparatus according to claim 11, wherein said regions divided up by said crosspieces have only one inlet opening out into an interior of said side cavities.

13. The apparatus according to claim 11, further comprising at least partially air-permeable wall, said regions divided up by said crosspieces being closed and separated from an interior of said side cavities by said at least partially air-permeable wall.

14. The apparatus according to claim 1, wherein said air-permeable partition wall directs air to flow with a time delay into said at least one indirectly inflated cavity.

15. The apparatus according to claim 1, wherein:

said inflatable body defines an enclosure; and said directly inflated cavity defines an enclosure releaseably connected to said enclosure of said inflatable body.

16. The apparatus according to claim 2, wherein said directly inflated cavity defines an enclosure releaseably connected to said air-permeable enclosure.

17. The apparatus according to claim 1, wherein:

said inflatable body defines an enclosure;

said directly inflated cavity defines an enclosure; and said enclosure of said directly inflated cavity is connected in at least one of punctiform and linear fashion to said enclosure of said inflatable body.

18. The apparatus according to claim 1, wherein the items of clothing are shirts.

* * * * *